US007019648B2

(12) United States Patent
Gagnon

(10) Patent No.: US 7,019,648 B2
(45) Date of Patent: Mar. 28, 2006

(54) INTRUDER/ESCAPEE DETECTION SYSTEM

(75) Inventor: André Gagnon, Hull (CA)

(73) Assignee: AuraTek Security Inc., Vestal, NY (US)

( * ) Notice: Subject to any disclaimer, the term of this patent is extended or adjusted under 35 U.S.C. 154(b) by 162 days.

(21) Appl. No.: 10/272,381

(22) Filed: Oct. 17, 2002

(65) Prior Publication Data

US 2003/0107484 A1 Jun. 12, 2003

Related U.S. Application Data

(60) Provisional application No. 60/329,547, filed on Oct. 17, 2001.

(51) Int. Cl.
*G08B 13/18* (2006.01)

(52) U.S. Cl. ..... 340/552; 340/561; 340/565

(58) Field of Classification Search ..... 340/552, 340/551, 553, 554–565, 541
See application file for complete search history.

(56) References Cited

U.S. PATENT DOCUMENTS

| | | | | |
|---|---|---|---|---|
| 4,887,069 | A | 12/1989 | Maki | |
| 4,994,789 | A | 2/1991 | Harman | |
| 5,446,446 | A * | 8/1995 | Harman | 340/566 |
| 5,448,320 | A * | 9/1995 | Sakai et al. | 396/427 |
| 5,473,336 | A * | 12/1995 | Harman et al. | 343/790 |
| 5,559,496 | A * | 9/1996 | Dubats | 340/539.26 |
| 5,790,025 | A * | 8/1998 | Amer et al. | 340/571 |
| 5,936,666 | A * | 8/1999 | Davis | 348/143 |
| 6,127,926 | A * | 10/2000 | Dando | 340/541 |
| 6,424,259 | B1 | 7/2002 | Gagnon | |

FOREIGN PATENT DOCUMENTS

| | | |
|---|---|---|
| WO | WO 91/13415 | 9/1991 |
| WO | WO 94/07222 | 3/1994 |
| WO | WO/97/22955 | 6/1997 |
| WO | WO 98/55972 | 12/1998 |

* cited by examiner

*Primary Examiner*—Toan N. Pham
(74) *Attorney, Agent, or Firm*—Thomas Adams

(57) ABSTRACT

A detection system for detecting intruders moving in the vicinity of a defined path comprises a distributed antenna, for example an open transmission line, extending along the path, and an array of discrete antennas extending alongside the distributed antenna and within a predetermined distance therefrom. The discrete antennas and the distributed antenna define a plurality of detection zones. A radio frequency transmitter is connected to each of the discrete antennas, and a complementary receiver in a control unit at a remote location is connected to the distributed antenna. The control unit also controls the transmitters, and the array of antennas to exchange radio frequency energy between the distributed antenna and the discrete antennas and analyzes the energy received from the discrete antennas so as to detect perturbations caused by an intruder moving adjacent said path and adjacent a particular antenna. A plurality of cameras are associated with the plurality of discrete antennas, and coupled to the control means for transmission of video signals thereto. The control means selects for display a signal from a particular camera in dependence upon the detection of a perturbation from an adjacent discrete antenna.

6 Claims, 7 Drawing Sheets

Look forward camera

θ : angle of view of the camera and the therefore radiation.

D : Distance between fence and sensor cable.

L : Zone length.

f1 + f2 : Frequency of the transmitter f1 and f2.

Look sidewards cameras

θ : angle of view of the camera and the therefore radiation.

D : Distance between fence and sensor cable.

L : Zone length.

INTRUDER/ESCAPEE DETECTION SYSTEM

This application claims priority from U.S. Provisional patent application No. 60/329,547 filed Oct. 17, 2001.

TECHNICAL FIELD

The invention relates to detection systems and methods and, in particular, to detection systems and methods which are used to detect objects or people moving in the vicinity of a distributed antenna, for example an open transmission line. The invention is especially applicable to the detection of intruders or escapees.

BACKGROUND ART

Known such detection systems use at least one open transmission line, usually a leaky cable, as a distributed receiving antenna to receive a radio frequency signal transmitted from an associated antenna; or as a transmitting antenna to transmit signals for reception by a separate antenna. An intruder or escapee, or other object, moving in the vicinity of the leaky cable causes a perturbation in the coupling of continuous wave RP energy into or from the leaky cable. Detection of the perturbation indicates an intrusion or escape attempt. It will be appreciated that there is technically no distinction between an intruder traversing the path to enter a protected zone and an escapee traversing the path to leave a protected zone. For convenience, therefore, in this specification, the term "intruder" will be used to cover both.

It is desirable to determine, at least approximately, the location of the intruder along the length of the cable, U.S. Pat. No. 4,994,789 (Harman) issued Feb. 19, 1991 discloses a detection system in which several detection zones are provided by interposing phase-shifting modulators at intervals along the leaky cable. Each modulator can be shunted by a switch. A signal processor analyzes the signal received from the cable while the switch is operated so as to shunt the modulator or connect it in series with the cable sections, thereby allowing determination of the section in which the intrusion occurred. When such a system uses only two zones, it may be relatively economical. However, when such a system is expanded to many zones, the interdependence of the modulators, the complexities of switching them, and intricacies of signal analysis prohibitively increase cost and reduce reliability.

U.S. Pat. No. 4,887,069 (Maki) issued Dec. 12, 1989 discloses a detection system which uses two coaxial cables, one of them a leaky cable, extending along a perimeter of a protection zone, one coupled to a transmitter and the other to a receiver. The cables are subdivided into sections which are interconnected by oscillators and switches allowing selection of one section at a time. If a section has not been selected, the RF signal passes along its inner conductor. When a section is selected, the RF signal is switched to propagate as an external wave along the outer sheath of the cable section. Maki also discloses a system in which both of the coaxial cables are leaky cables, with zones provided by serialized switching, each zone being powered from a switched local oscillator. In either case, signal perturbations caused by an intruder are transmitted through the intervening sections to a receiver located at one end of the cable. The oscillators and switches increase complexity and reduce reliability.

My copending U.S. patent application Ser. No. 09/891,520 filed Jun. 27, 2001, the entire contents of which are incorporated herein by reference, discloses intruder/escapee detection apparatus which comprises a plurality of discrete antennas distributed alongside a leaky cable. If an intruder/escapee disturbs the field between one or more of the discrete antennas and the leaky cable, a receiver will detect the perturbation in the received signal and operate an alarm. Preferably, the discrete antennas are selected individually so that the location of the intruder can be determined approximately by identifying the antenna whose signal was perturbed.

For various reasons, such as avoidance of false alarms, it may be desirable to capture an image of an area in which an intruder/escapee seems to have been detected.

An object of the present invention is to provide an intruder/escapee detection system allowing detection, location and imaging of an intruder/escapee.

DISCLOSURE OF INVENTION

According to the present invention, a detection system for detecting intruders moving in the vicinity of a defined path comprises a distributed antenna, for example an open transmission line, extending along the path and an array of discrete antennas extending alongside the distributed antenna and within a predetermined distance therefrom, the discrete antennas and the distributed antenna defining a plurality of detection zones, a radio frequency transmitter connected to each of the discrete antennas, a complementary receiver connected to the distributed antenna, and control means for controlling the transmitters, receiver and array of antennas to exchange radio frequency energy between the distributed antenna and selected ones of the discrete antennas and to analyze the energy received from said selected ones of the discrete antennas so as to detect perturbations caused by an intruder moving adjacent said path and adjacent that particular antenna, wherein the system further comprises a plurality of cameras associated with the plurality of discrete antennas, and coupled to the control means for transmission of video signals thereto in response to selection signals from the control means, and the control means further comprises means for selecting for display a signal from particular camera in dependence upon the detection of a perturbation from an adjacent discrete antenna.

The cameras may be disposed in a plurality of pairs, each pair located at one of the discrete antennas, the antennas in each pair being directed in opposite directions so that each camera captures an image of a detection zone of a neighbouring discrete antenna, and the control means, in response to a perturbation for said particular detection zone selects two cameras, one from each of two pairs associated with neighbouring discrete antennas, so as to capture two different images of the particular detection zone.

Alternatively, each antenna unit may comprise a pair of antenna elements having radiation fields directed away from each other and towards a neighbouring antenna unit and a pair of cameras, each camera having a field of view generally similar to a radiation field of a respective one of the antenna elements, and the control means may be responsive to perturbations in received signals corresponding to antenna elements spaced one each side of a detection zone to select video signals from two cameras associated with those spaced antenna elements and having their fields of view directed towards that detection zone.

The cameras may each have a drive unit having network communication capablility and may be interconnected by a network path, conveniently by way of the transmission path interconnecting the discrete antennas, for communication with the control unit using a suitable network protocol. Such cameras are readily available for connection to the Internet for remote monitoring purposes and have an Internet Protocol (IP) address assigned thereto.

Preferably, the transmission path interconnecting the discrete antennas is used to convey control signals to the discrete antennas and selection signals to the cameras, but is not used to convey radio frequency signals.

The or each camera could be embedded into a respective one of the antennas, preferably so that it is hidden, Video signals from the cameras to a monitoring station could be transmitted via the coaxial antenna cable. The power supply to the cameras could be via the coaxial cable.

Where the antenna cable is deployed in an elevated location, such as along a fence or on the roof of a building, surveillance cameras could be installed at intervals along its length.

The discrete antennas may comprise localized antennas, such as patch antennas, each associated with a local transmitter or receiver, as appropriate. Alternatively, the discrete antennas could be short distributed antennas, such as leaky cables, that are much shorter than the main distributed antenna and each be connected to a local transmitter or receiver, as appropriate.

The control means may comprise switching means for selecting each one of the discrete antennas individually for such energy exchange.

The control means may select the antennas in turn in such a sequence that, if the energy from a particular antenna when previously selected within a prescribed time period showed a perturbation, that antenna would be selected more frequently than those antennas which had not shown such a perturbation within said time period.

Preferably, the array of antennas are each connected to a respective one of a plurality of taps distributed along a transmission line extending alongside the distributed antenna. The control means then may comprise a plurality of switching devices for connecting respective ones of the antennas to the transmission line and switch control means for controlling operation of the switching devices to select the antennas individually.

The switch control means may comprise a means for transmitting antenna addresses selectively onto the transmission line and each switching device then may comprise an address decoder for detecting the address of the associated antenna and an RF switch operable by the decoder to connect the antenna to the transmission line.

DETAILED DESCRIPTION OF PREFERRED EMBODIMENTS

Figure 1:
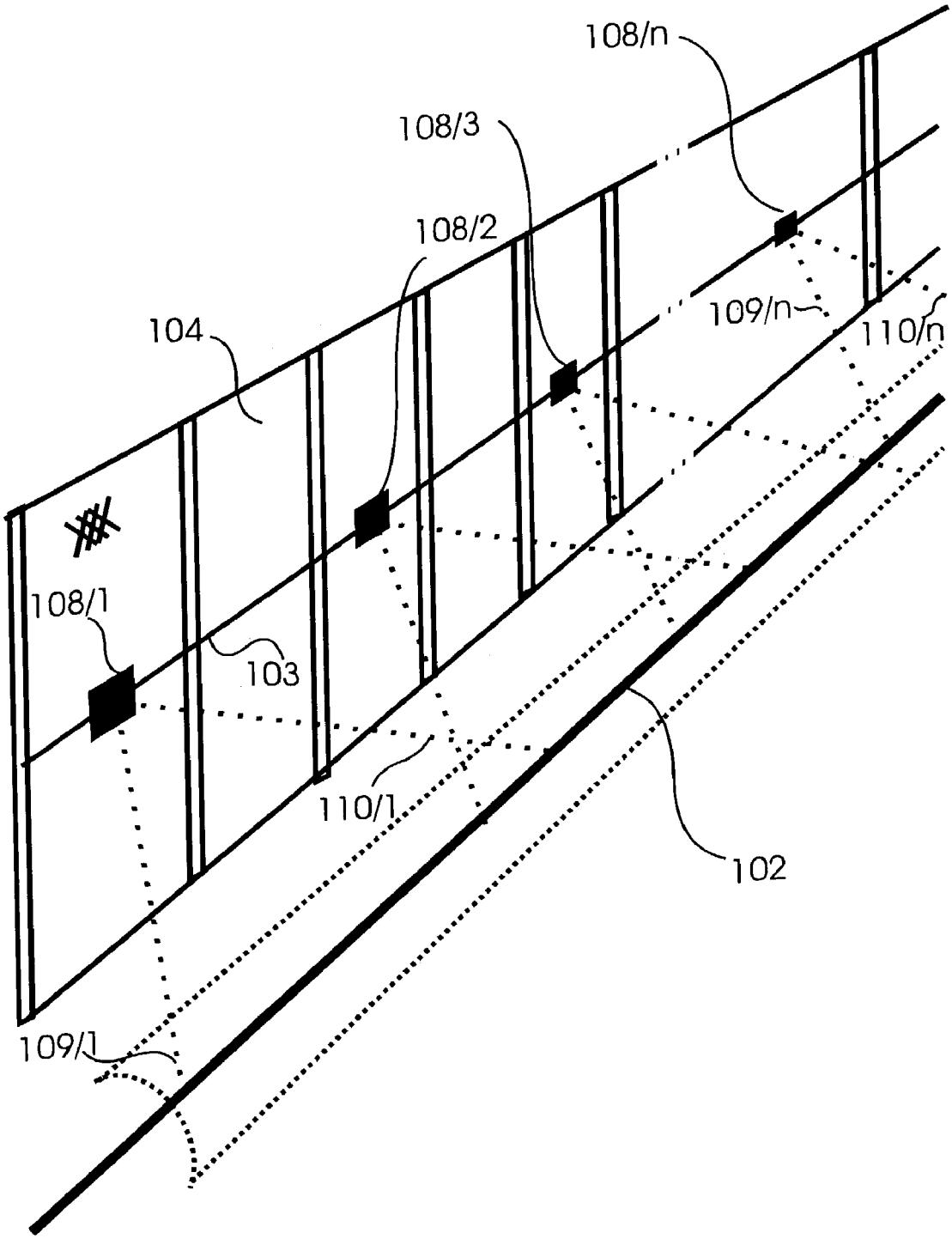
FIG. 1 illustrates a section of a perimeter fence having a plurality of discrete antenna units attached to one side and facing towards a distributed antenna running alongside the fence.
Figure 2B:
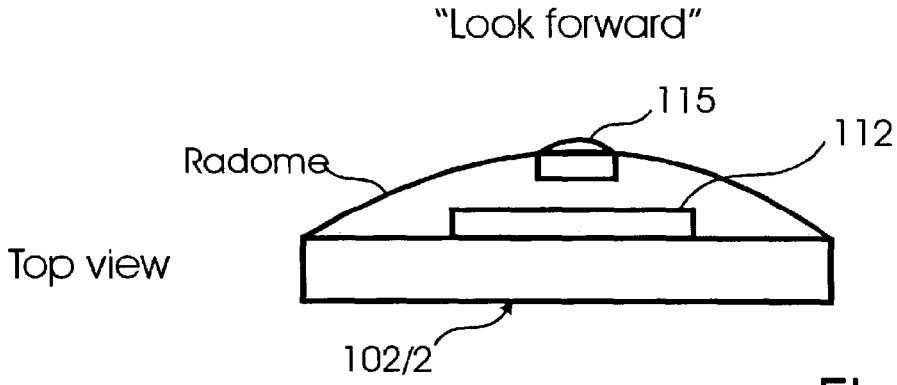
FIG. 2B is a top sectional view of the antenna unit of FIG. 2A.
Figure 2A:
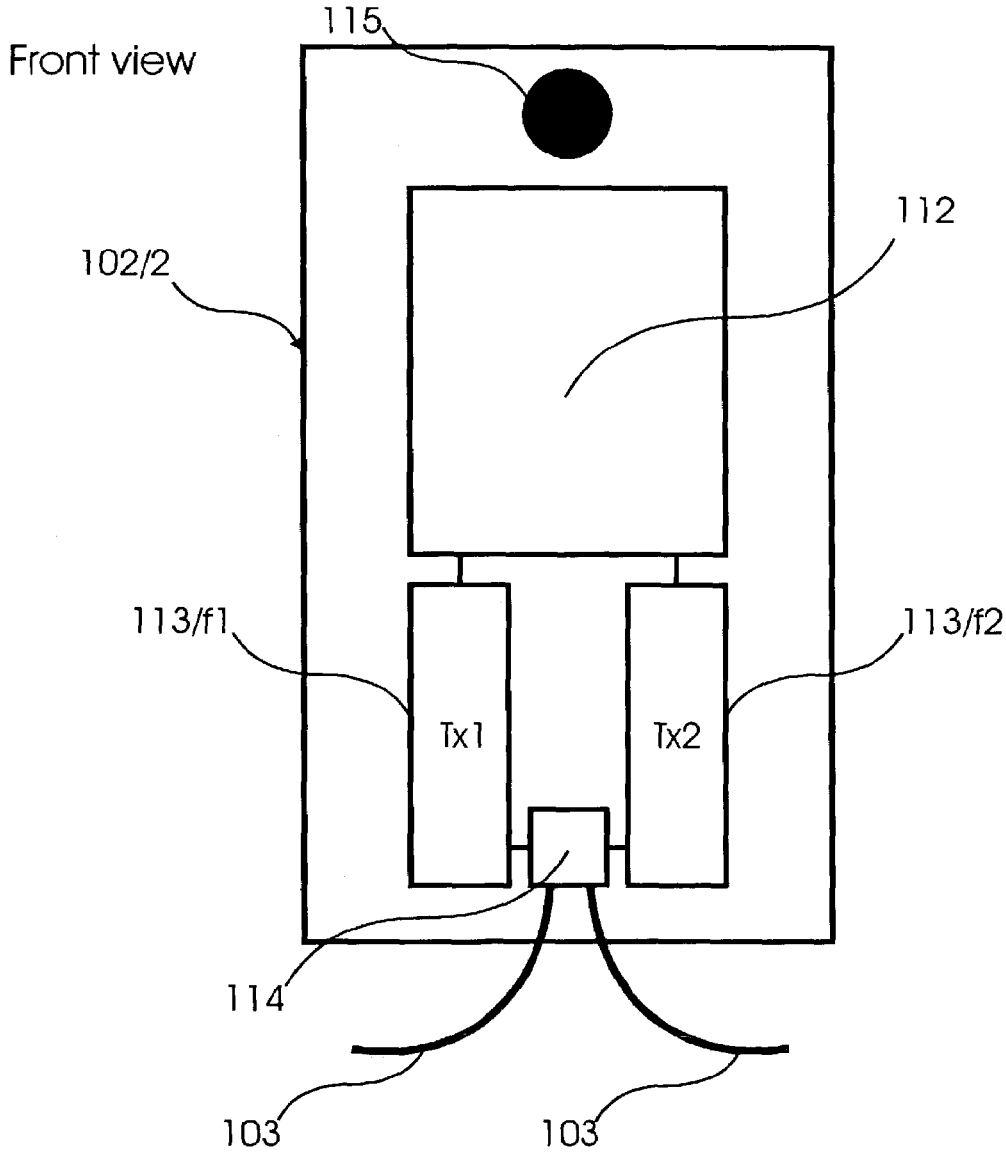
FIG. 2A is a front view of one of the antenna units including a camera.
Figure 3:
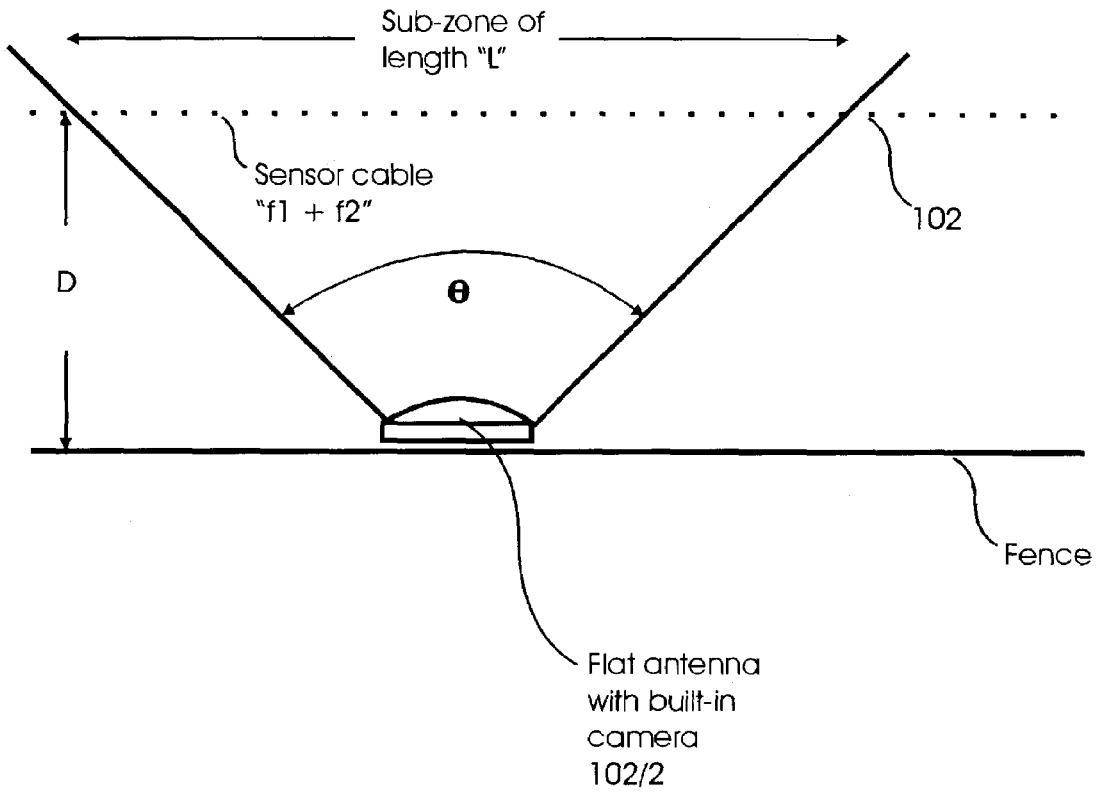
FIG. 3 is a simplified schematic diagram of one of the antenna units.

For convenience of illustration, FIG. 1 illustrates only a portion, including several detection zones, of an intruder/escapee detection system. The system comprises a leaky coaxial cable 102 or other suitable open transmission line means, either laid upon the surface of the ground or buried a short distance beneath the surface, which defines a detection path or line to be monitored. A transmission line 103, conveniently a regular coaxial cable, is shown mounted along a security fence 104 (but alternatively may be buried along the base of the fence 104). The cable 102 is depicted, for purposes of illustration only, as having a detection field 102*a* extending radially around it. It will be appreciated that, if the cable 102 is connected to a receiver, the detection field 102*a* will be induced rather than generated directly. The transmission line 103 has a plurality of taps 103/1 . . . 103/n spaced apart along its length. The taps are connected by switching devices 107/1 . . . 107/n, respectively, to a corresponding plurality of small antenna units 108/1 . . . 108/n, respectively. Each tap is a T-junction allowing communication between the antenna units and a remote control unit (not shown) without the continuity of the transmission line 103 being interrupted. The antenna units 108/1 . . . 108/n are spaced from the cable 102 to provide a required degree of coupling therebetween while giving some room for a body to intrude into the detection zones. In operation, electromagnetic fields between the leaky cable 102 and the plurality of taps 103/1 . . . 103/n define a corresponding plurality of overlapping detection zones depicted, for purposes of illustration only, by lines 109/1;110/1; . . . 109/n; 110/n, respectively.

In one experimental setup, the leaky cable 102 and the transmission line 103 were spaced about 20 feet apart and up to 2 miles in length with the antennas at intervals of 50 feet or so. Thus, typically, each antenna unit forms a perimeter sub-zone about 50 ft long, each sub-zone overlapped with its neighbouring sub-zone to obtain full coverage.

Figure 4:
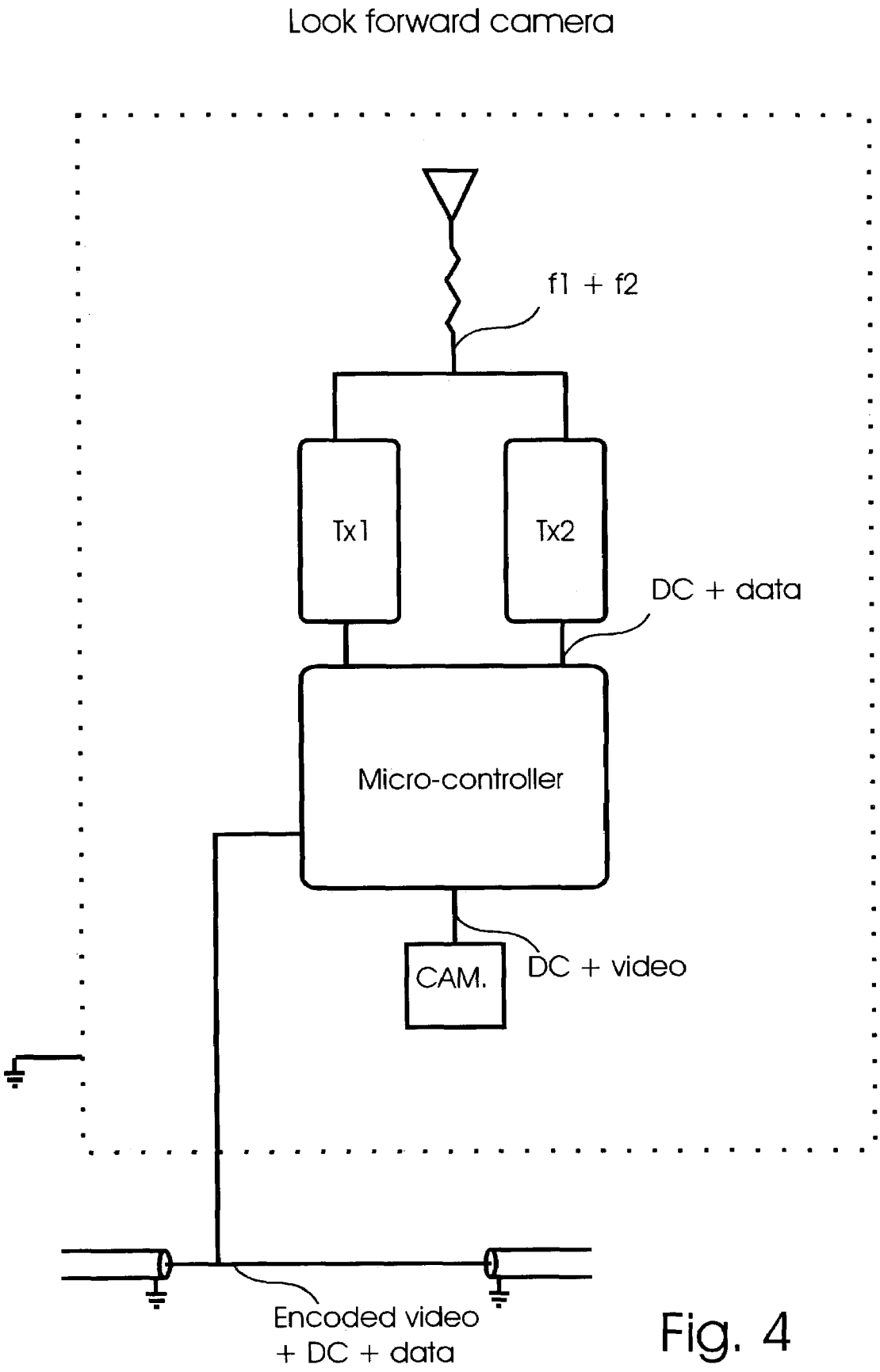
FIG. 4 illustrates the angle of view of the camera and field of the antenna.

The antenna units 108/1 . . . 108/n may use different pairs of transmission frequencies but otherwise have the same construction, so only one of them, antenna unit 108/2, will be described with reference to FIGS. 2A, 2B, 3 and 4. The antenna unit 108/n comprises a baseplate 111 having means (not shown) for attaching it to the fence (or other support). A flat patch antenna element 112 is mounted flat upon the baseplate 111 and connected to two transmitters 113/f1 and 113/f2 which use the frequencies f1 and f2, respectively. A microcontroller 114 controls the two transmitters 113/f1 and 113/f2 in response to control signals received via the transmission line 103. A miniature camera 115 is mounted above the patch antenna 112 and controlled by the microcontroller 114. As shown in FIG. 4, the camera 115 has a field of view similar to the radiation field of the antenna element 112 In addition to the control signals, D.C. power to operate the microcontroller 114, transmitters 113/f1 and 113/f2 and the camera 115 is supplied by way of the transmission line 103 and video signals from the camera 115 are transmitted via the transmission line 103 to the remote control unit.

The remote control unit will include a receiver and processor for detecting perturbations in RF signals received by the leaky cable 102 caused by an intruder. Such receivers and processors are known to persons skilled in this art and so will not be described in detail here. For examples, the reader is directed to International patent applications numbers PCT/CA91/00050, PCT/CA98/00551 and PCT/CA96/00840, which are incorporated herein by reference. The remote unit will also have a controller for selecting antenna units and transmission frequencies for each antenna unit, and for selecting cameras in dependence upon the detection of an intruder. It will also have video display capability and/or means for routing video signals for display elsewhere, perhaps at a remote surveillance station. It is envisaged that the antenna units could be selected individually (or in small groups) allowing the same frequencies to be used by different antenna units, as described in copending application Ser. No. 09/891,520, Alternatively, each of the antenna units could use a different pair of frequencies and transmit continuously, in which case the receiver and processor would be configured to detect at all of the different frequencies in the signal received from the leaky cable 102.

The remote control unit will send control signals to the microcontrollers in the antenna units to select the frequencies f1 and f2 according to local conditions, for example to avoid local interference or jamming by using one or other of them, or simply to enhance detection capability by using both. Hence, the antenna unit (specifically their microcontrollers) each will be assigned a network address and the remote control unit will use conventional network addressing protocols to communicate with them, for example Ethernet over Internet Protocol. Each camera then will have an Internet Protocol address which the remote control unit and the local microcontroller will use for control and communication purposes.

In operation, when the remote control unit detects a perturbation near one of the antenna units, it will select the video signal from the associated camera for display, allowing an operator to verify perhaps that it is not a false alarm and enabling an image of an intruder to be captured and stored.

Figure 5B:
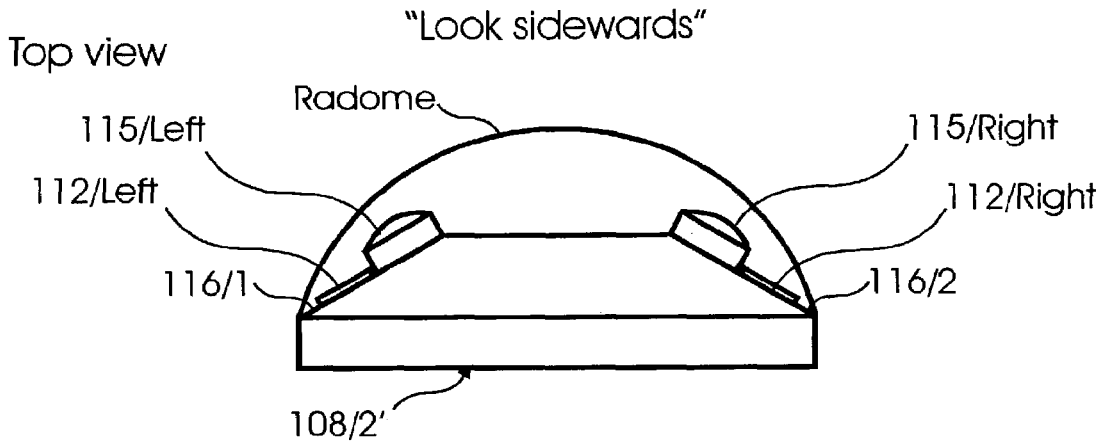
FIG. 5B is a top view of the antenna unit of FIG. 5A.
Figure 5A:
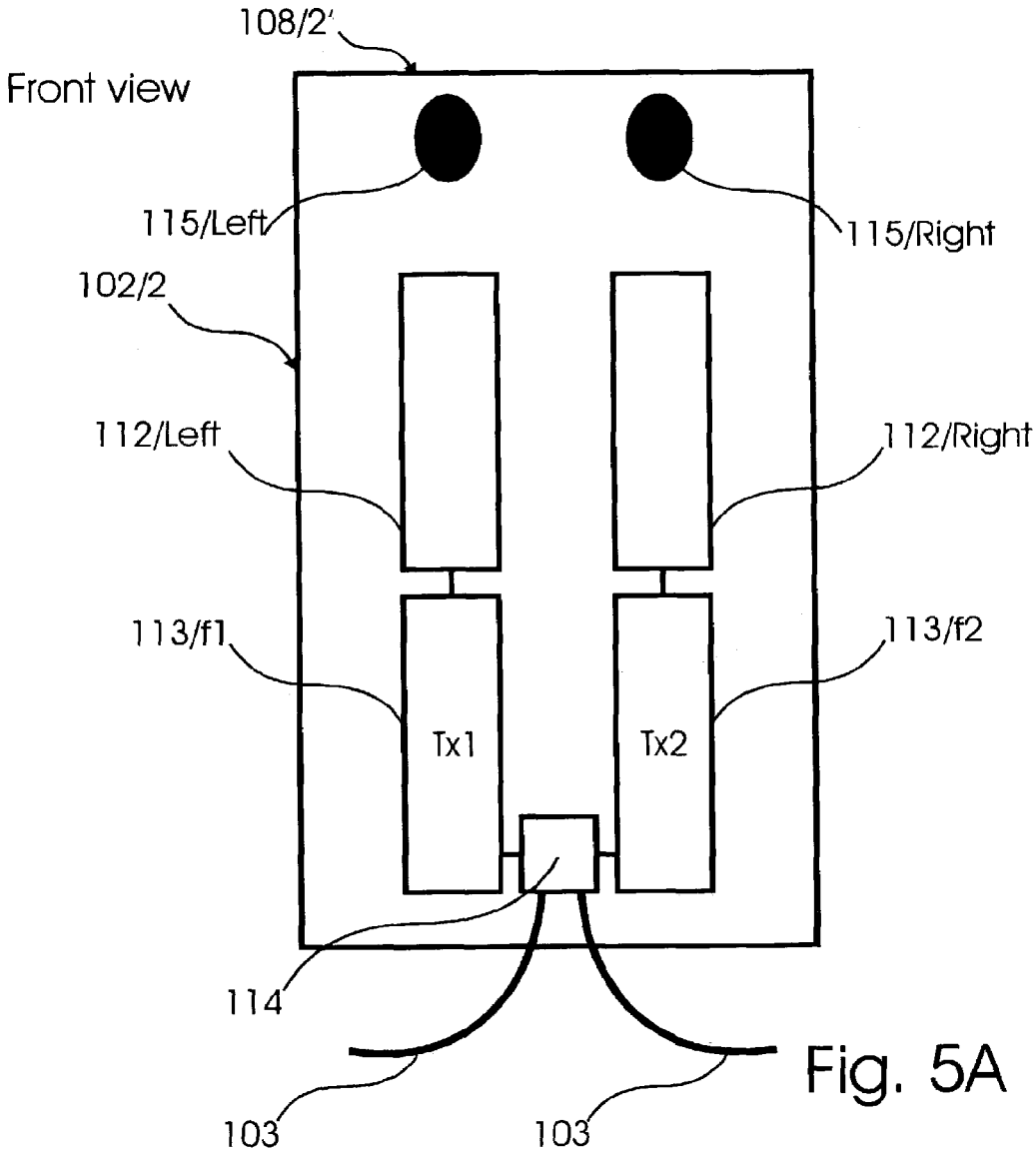
FIG. 5A is a front view of an alternative antenna unit having two cameras.
Figure 6:
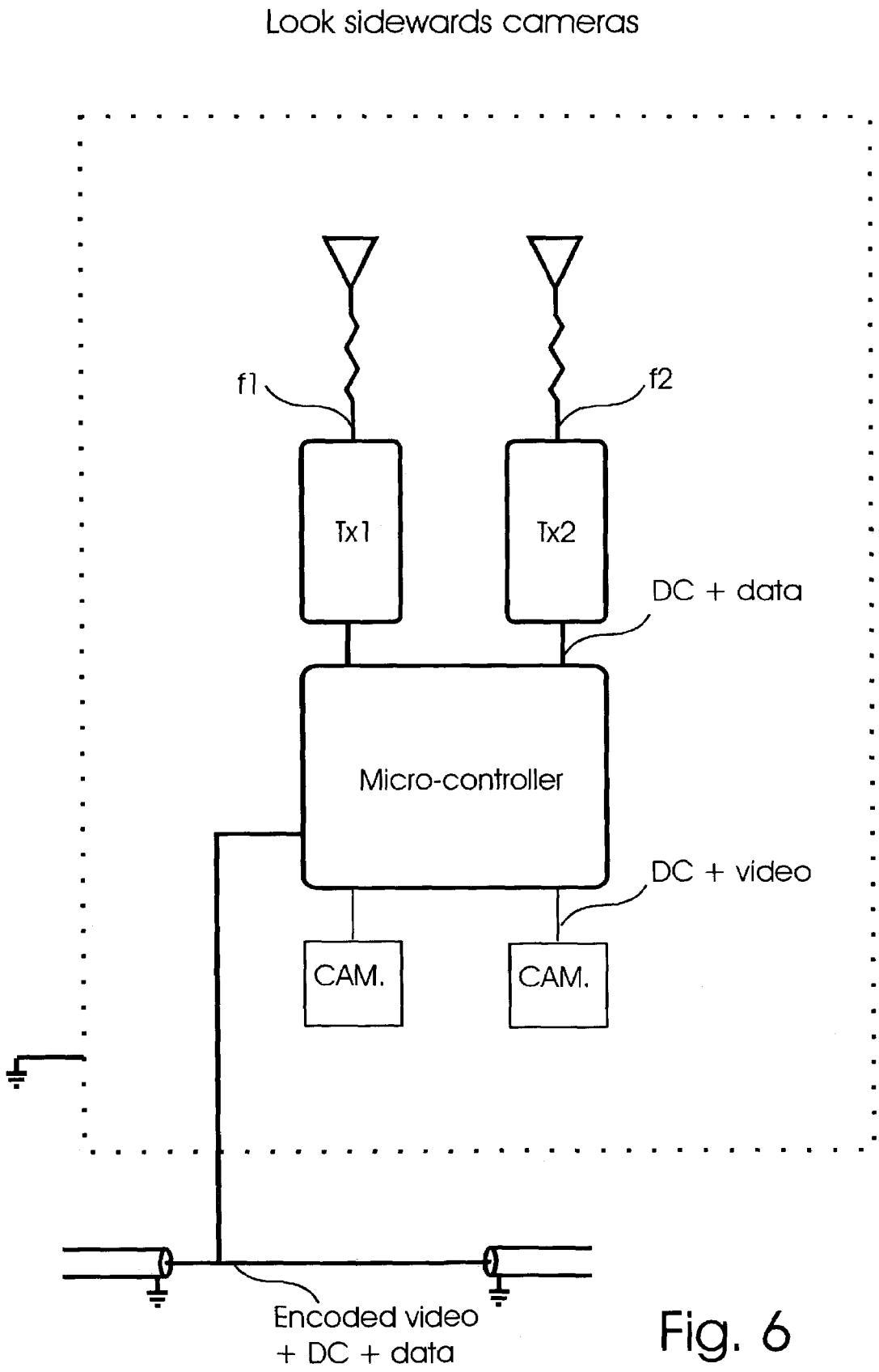
FIG. 6 is a simplified schematic diagram of the antenna unit of FIGS. 5A and 5B.

Referring again to FIG. 4, and assuming again a zone length L of 50 ft., an angle θ of the field of view of the camera and the RF radiation field, a distance D between the antenna unit and the leaky cable 102, distance D will be relatively large, perhaps greater than L/5. Particularly where it is desirable for the antenna units and the leaky cable to be closer together, each antenna unit may be equipped with two cameras each directed sideways rather than forwards. Also, each antenna unit might have two patch antenna elements. Such an antenna unit 108/2' will now be described with reference to FIGS. 5A, 5B and 6. As shown in FIGS. 5A and 5B, the antenna unit 108/2' has two patch antenna elements 112/1 and 112/2 coupled to transmitters 113/f1 and 113/12, respectively. As before, the transmitters 113/f1 and 113/f2 are controlled by a microcontroller 114.

As shown in FIG. 5B, the baseplate 111' has inclined surfaces 116/1 and 116/2 at opposite sides which carry the patch antennas 112/1 and 112/2, respectively so that each patch antenna radiates away from the middle of the antenna unit 108/2. The two cameras 115/1 and 115/2 also are mounted to the inclined surfaces 116/1 and 116/2, respectively, adjacent the patch antennas 112/1 and 112/2, respectively, so that the field of view of each camera is similar to the radiation field of the adjacent patch antenna.

Figure 7:
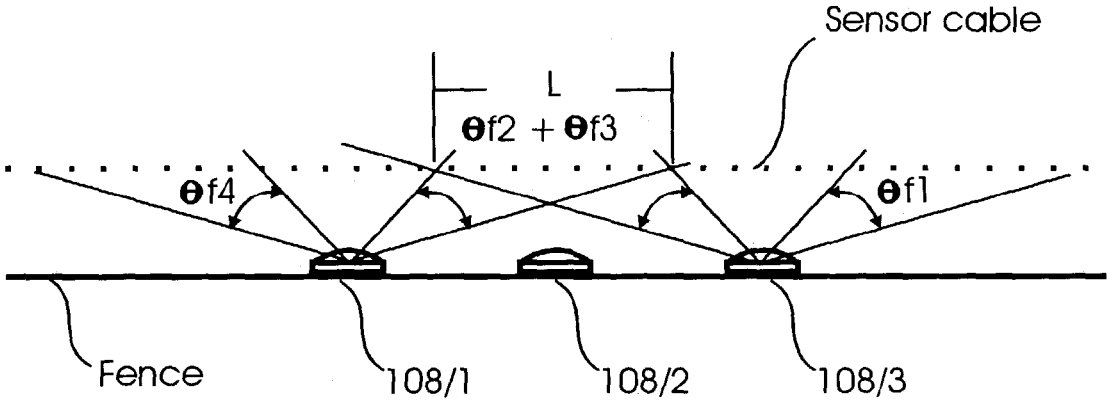
FIG. 7 illustrates the angle of view of each of the cameras mounted on three adjacent antenna units.

As shown in FIG. 7, which illustrates antenna units 108/1, 108/2 and 108/3 and their radiation zones, each detection zone, i.e., stretch of leaky cable 102, is irradiated by the two adjacent patch antennas. Thus, the detection zone corresponding to antenna unit 108/2 is irradiated by LEFT patch antenna element of antenna unit 112/1 and the RIGHT patch antenna element of antenna unit 112/3. In this case, the receiver and processor unit at the remote control unit will determine an intrusion by detecting the perturbation in the received signals corresponding to those transmitted by LEFT patch antenna element of antenna unit 112/1 and the RIGHT patch antenna element of antenna unit 112/3. Once the potential intrusion has been detected, the remote control unit will automatically select the video signals from corresponding LEFT and RIGHT cameras of antenna units 108/1 and 108/2 to obtain images of the intervening selection zone from both sides.

It is also envisaged that a pair of sideways-facing cameras could be mounted on an antenna unit having only one, forward-facing patch antenna. The receiver and processor at the remote control unit then would detect an intruder based upon perturbation of the signal from one antenna unit and then select one camera from each of the adjacent antenna units.

It is also envisaged that the invention could be implemented with other kinds of antenna element. For example, instead of a patch antenna, the discrete antennas could comprise lengths of leaky cable with interposed transmitters. Each transmitter would energize the adjacent length of cable and set up a radiation field extending laterally towards the "receiving" leaky cable.

It is also envisaged that a combination of the "time multiplexing" scheme disclosed in copending application Ser. No. 09/891,520 and "frequency multiplexing" i.e. using different frequencies or frequency pairs for different groups of discrete antennas and distributed antennas, could be employed so as to increase the number of discrete antennas in the system and cover a larger area.

The invention claimed is:

1. A detection system for detecting intruders moving in the vicinity of a defined path comprises a distributed antenna extending along the path, and an array of discrete antennas extending alongside the distributed antenna and within a predetermined distance therefrom, the discrete antennas and the distributed antenna defining a plurality of detection zones, a radio frequency transmitter connected to each of the discrete antennas, a complementary receiver connected to the distributed antenna, and control means for controlling the transmitters, receiver and array of antennas to exchange radio frequency energy between the distributed antenna and the discrete antennas and to analyze the energy received from said the discrete antennas so as to detect perturbations caused by an intruder moving adjacent said path and adjacent a particular antenna, a plurality of cameras associated with the plurality of discrete antennas and coupled to the control means for transmission of video signals thereto, the control means further comprising means for selecting for display a signal from a particular camera in dependence upon the detection of a perturbation from an adjacent discrete antenna.

2. A system according to claim 1, wherein the cameras are disposed in a plurality of pairs, each pair located at one of the discrete antennas, the antennas in each pair being directed in opposite directions so that each camera captures an image of at least part of a neighbouring detection zone, and the control means, in response to detection of a perturbation indicating an intruder in said neighboring detection zone, selects two cameras, one from each of two pairs associated with discrete antennas adjacent said neighbouring zone, so as to capture two different images of said neighbouring detection zone.

3. A system according to claim 2, wherein the distributed antenna comprises an open transmission line.

4. A system according to claim 1, wherein each antenna unit comprises a pair of antenna elements having radiation fields directed away from each other and towards a neighboring antenna unit and a pair of cameras, each camera having a field of view generally similar to a radiation field of a respective one of the antenna elements, and the control means is responsive to perturbations in received signals corresponding to antenna elements spaced one each side of a detection zone to select video signals from two cameras associated with those spaced antenna elements and having their fields of view directed towards that detection zone.

5. A system according to claim 4, wherein the distributed antenna comprises an open transmission line.

6. A system according to claim 1, wherein the distributed antenna comprises an open transmission line.

* * * * *

UNITED STATES PATENT AND TRADEMARK OFFICE

CERTIFICATE OF CORRECTION

PATENT NO. : 7,019,648 B2
APPLICATION NO. : 10/272381
DATED : March 28, 2006
INVENTOR(S) : André Gagnon It is certified that error appears in the above-identified patent and that said Letters Patent is hereby corrected as shown below:

On Title Page, Item (73) should read, assignee to read: AuraTek Security LLC

Signed and Sealed this

Twenty-eighth Day of November, 2006

JON W. DUDAS
*Director of the United States Patent and Trademark Office*